US009865446B2

(12) United States Patent
Kovtoun

(10) Patent No.: US 9,865,446 B2
(45) Date of Patent: Jan. 9, 2018

(54) SYSTEMS AND METHODS FOR REDUCING THE KINETIC ENERGY SPREAD OF IONS RADIALLY EJECTED FROM A LINEAR ION TRAP

(71) Applicant: Thermo Finnigan LLC, San Jose, CA (US)

(72) Inventor: Viatcheslav V. Kovtoun, Santa Clara, CA (US)

(73) Assignee: Thermo Finnigan LLC, San Jose, CA (US)

( * ) Notice: Subject to any disclaimer, the term of this patent is extended or adjusted under 35 U.S.C. 154(b) by 0 days.

(21) Appl. No.: 15/165,192

(22) Filed: May 26, 2016

(65) Prior Publication Data

US 2017/0345636 A1 Nov. 30, 2017

(51) Int. Cl.
*H01J 49/00* (2006.01)
*H01J 49/42* (2006.01)

(52) U.S. Cl.
CPC ..... *H01J 49/423* (2013.01); *H01J 49/426* (2013.01)

(58) Field of Classification Search
None
See application file for complete search history.

(56) References Cited

U.S. PATENT DOCUMENTS 5,468,958 A * 11/1995 Franzen ..... H01J 49/424 250/282
7,157,698 B2 * 1/2007 Makarov ..... H01J 49/004 250/281
7,323,683 B2 * 1/2008 Krutchinsky ..... H01J 49/423 250/281
7,378,653 B2 * 5/2008 Wells ..... H01J 49/005 250/281

(Continued)

FOREIGN PATENT DOCUMENTS

WO 2008/097243 A2 8/2008
WO WO 2014176316 A2 * 10/2014 ..... H01J 49/406
WO WO 2014176316 A3 * 4/2015 ..... H01J 49/406

OTHER PUBLICATIONS

Frankevich, et al., "Deceleration of high-energy matrix-assisted laser desorption/ionization ions in an open cell for Fourier transform ion cyclotron resonance mass spectrometry", Rapid Comm. Mass Spectrom., 2001, 15, pp. 2035-2040.

(Continued)

*Primary Examiner* — Andrew Smyth
(74) *Attorney, Agent, or Firm* — David A. Schell

(57) ABSTRACT

A system for analyzing a sample includes a linear ion trap, an insert DC electrode, a voltage controller, and an RF control circuitry. The linear ion trap includes a first pair of trap electrodes and a second pair of trap electrodes spaced apart from each other and surrounding a trap interior. An electrode of the second pair of trap electrodes includes a trap exit. The insert DC electrode is positioned adjacent to the (Continued)

trap exit. The voltage controller applies a DC voltage to the insert DC electrode. The RF control circuitry applies a main RF voltage to the first pair of trap electrodes, applies a portion of the main RF to the second pair of trap electrodes, increases the main RF applied to the first pair of trap electrodes, and applies an auxiliary RF voltage to the second pair of trap electrodes.

23 Claims, 13 Drawing Sheets

(56) References Cited

U.S. PATENT DOCUMENTS

| | | | | |
|---|---|---|---|---|
| 8,158,934 | B2 * | 4/2012 | Wells | H01J 49/0054 250/281 |
| 8,164,053 | B2 * | 4/2012 | Sugiyama | H01J 49/0045 250/281 |
| 8,637,816 | B1 | 1/2014 | Mordehai et al. | |
| 8,664,591 | B2 * | 3/2014 | Newton | H01J 49/02 250/283 |
| 2007/0176098 | A1 * | 8/2007 | Wells | H01J 49/423 250/292 |
| 2012/0168619 | A1 | 7/2012 | Guna | |
| 2014/0034825 | A1 * | 2/2014 | Newton | H01J 49/02 250/282 |

OTHER PUBLICATIONS

Myung et al, "High-capacity ion trap coupled to a time-of-flight mass spectrometer for comprehensive linked scans with no scanning losses", Int. J. Mass. Spectrom., 301, 2011, pp. 211-219.

Wang, et al., "A Qit-q-Tof mass spectrometer for two-dimensional tandem mass spectrometry", Rapid Commun. Mass Spectrom. 2007 (21), pp. 3223-3226.

* cited by examiner

SYSTEMS AND METHODS FOR REDUCING THE KINETIC ENERGY SPREAD OF IONS RADIALLY EJECTED FROM A LINEAR ION TRAP

FIELD

The present disclosure generally relates to the field of mass spectrometry including systems and methods for reducing the kinetic energy spread of ions radially ejected from a linear ion trap.

INTRODUCTION

A linear ion trap (LIT) is a type of ion trap that can be used in mass spectrometry. In a linear ion trap, ions can be confined radially by a two-dimensional radio frequency (RF) field, and axially by stopping potentials applied to end electrodes. Since linear ion traps have high injection efficiencies and high ion storage capacities, they can be used to handle large ion populations for high-throughput two-dimensional mass spectrometry.

Ions can be injected into or created within the interior of the ion trap. The ions can be confined or trapped within the center section of the ion trap by application of appropriate RF and DC voltages. The voltages applied to the ion trap can be adjusted to Ions can be ejected from the trap by applying the RF voltage to all sections of the trap and utilizing a supplemental dipolar resonance ejection voltage. These changes can cause the ions to become unstable in the direction of dipolar excitation and leave the trapping field. By increasing the RF voltage linearly, the ions can be ejected from the trap sequentially to produce a mass spectrum.

From the foregoing it will be appreciated that a need exists for improved systems and methods for reducing the kinetic energy spread of ions radially ejected from linear ion traps.

SUMMARY

In a first aspect, a system for analyzing a sample can include an ion source, an ion detector, a linear ion trap, an insert DC electrode, a voltage controller, and an RF control circuitry. The ion trap can include a plurality of trap electrodes spaced apart from each other and surrounding a trap interior, the plurality of trap electrodes including a first pair of trap electrodes and a second pair of trap electrodes. At least a first trap electrode of the second pair of trap electrodes can include a trap exit comprising an aperture, and the insert DC electrode can be positioned adjacent to the trap exit. The trap electrodes can be configured to generate a RF trapping field in the trap interior and for mass selective ejection of ions from the trap interior. The voltage controller can be configured to apply a DC voltage to the insert DC electrode. The RF control circuitry can be configured to apply a main RF voltage to the first pair of trap electrodes, apply a portion of the main RF to the second pair of trap electrodes and proportionally increase the main RF applied to the first pair of trap electrodes to maintain a voltage difference between the first and second pairs of trap electrodes, and apply an auxiliary RF voltage to the second pair of trap electrodes in a dipolar fashion. The RF control circuitry can be configured to apply a main RF voltage to the first pair of trap electrodes, apply a portion of the main RF to the second pair of trap electrodes and proportionally increase the main RF applied to the first pair of trap electrodes to maintain a voltage difference between the first and second pairs of trap electrodes, and apply an auxiliary RF voltage to the second pair of trap electrodes in a dipolar fashion. In various embodiments, the DC control circuitry can be configured to apply a variable DC voltage to both the first pair of trap electrodes and the second pair of trap electrodes, maintaining DC voltage difference between two pairs of trap electrodes close to 0.

In various embodiments of the first aspect, the absolute value of the DC voltage to the insert DC electrode can be between about 1000 V and about 5000 V. In particular embodiments, the absolute value of the DC voltage is between about 1500 V and about 3500 V. For positive ions, the DC voltage can be negative, and for negative ions, the DC voltage can be positive.

In various embodiments of the first aspect, the RF control circuitry can be configured to generate the auxiliary RF voltage at a frequency that is an integer fraction of a frequency of the main RF voltage. In particular embodiments, the RF control circuitry can be configured to eject ions with at a beta of about ⅔. In particular embodiments, the RF control circuitry can be configured to maintain the phase locking between the main RF voltage and the auxiliary RF voltage.

In various embodiments of the first aspect, the RF control circuitry can be configured to generate an auxiliary RF voltage having a frequency that is an integer fraction of a frequency of the main RF voltage and phase locking is provided between the main RF voltage and auxiliary RF voltage.

In various embodiments of the first aspect, the RF control circuitry can be configured to phase lock the auxiliary RF voltage and the main RF voltage with a phase shift ranging between 0 and 120 deg.

In various embodiments of the first aspect, the portion of the main RF voltage applied to the second pair of trap electrodes can be between about 2% and about 10% of the RF voltage applied to the voltage difference. In particular embodiments, the portion of the main RF voltage applied to the second pair of trap electrodes can be between about 3% and about 7% of the RF voltage applied to the voltage difference. In particular embodiments, the portion of the main RF voltage applied to the second pair of trap electrodes can be between about 4% and about 6% of the RF voltage applied to the voltage difference.

In various embodiments of the first aspect, the kinetic energy distribution factor (a percentage of 1000 m/z ions ejected within a 25 eV kinetic energy window) can be between about 50 and about 100, such as between about 60 and about 95, even between about 70 and about 90.

In various embodiments of the first aspect, the absolute value of DC voltage applied to the first and second pairs of the trap electrodes can be between 0 and 1000 V. In particular embodiments, the absolute value of DC voltage applied to the first and second pairs of the trap electrodes can be between 0 and 400 V.

In a second aspect, a method for identifying components of a sample can include supplying ions to a mass selective linear ion trap. The ion trap can include a plurality of trap electrodes spaced apart from each other and surrounding a trap interior and a DC insert electrode positioned adjacent to a trap exit aperture formed in at least one of the trap electrodes. The trap electrodes can be configured for generating a RF trapping field in the trap interior. The method can further include trapping the ions within the RF trapping field, applying a DC voltage to the insert DC electrode, applying a main RF voltage to the first pair of trap electrodes, applying a portion of the main RF to the second pair of trap electrodes, proportionally increase the main RF applied to the first pair of trap electrodes to maintain a voltage difference between the first and second pairs of trap electrodes, and selectively ejecting ions from the trap interior based on their mass by applying apply an auxiliary RF voltage to the second pair of trap electrodes. The auxiliary RF voltage can be applied 180° out of phase between the first and a second trap electrode of the second pair of trap electrodes. In various embodiments, the DC control circuitry applies the same value of the DC voltage both to the first and the second pairs of trap electrodes. DC voltage difference between the pairs in the interior of the ion trap where ions are ejected is maintained close to 0.

In various embodiments of the second aspect, the RF control circuitry can be configured to generate the auxiliary RF voltage at a frequency that is an integer fraction of a frequency of the main RF voltage. In particular embodiments, the RF control circuitry can be configured to eject ions with at a beta of about ⅔. In particular embodiments, the RF control circuitry can be configured to maintain the phase locking between the main RF voltage and the auxiliary RF voltage.

In various embodiments of the second aspect, the portion of the main RF voltage applied to the second pair of trap electrodes can be between about 2% and about 10% of the RF voltage applied to the voltage difference. In particular embodiments, the portion of the main RF voltage applied to the second pair of trap electrodes can be between about 3% and about 7% of the RF voltage applied to the voltage difference. In particular embodiments, the portion of the main RF voltage applied to the second pair of trap electrodes can be between about 4% and about 6% of the RF voltage applied to the voltage difference.

In various embodiments of the second aspect, the kinetic energy distribution factor can be between about 50 and about 100, such as between about 60 and about 95, even about 70 and about 90.

In a third aspect, a mass selective ion trapping device can include a plurality of trap electrodes spaced apart from each other and surrounding a trap interior. The plurality of trap electrodes can include a first pair of trap electrodes and a second pair of trap electrodes. At least one of the trap electrodes of the second pair of trap electrodes can include a trap exit comprising an aperture. The trap electrodes can be configured for generating a RF trapping field in the trap interior and for mass selective ejection of ions from the trap interior. The mass selective ion trapping device can further include an insert DC electrode positioned adjacent to the trap exit, a voltage controlled configured to apply a DC voltage to the insert DC electrodes, and an RF circuitry. The RF circuitry can be configured to apply a main RF voltage to the first pair of trap electrodes, apply a portion of the main RF to the second pair of trap electrodes, proportionally increase the main RF applied to the first pair of trap electrodes to maintain a voltage difference between the first and second pairs of trap electrodes, and apply an auxiliary RF voltage to the second pair of trap electrodes. The auxiliary RF voltage can be applied 180° out of phase between the first and a second trap electrode of the second pair of trap electrodes. In various embodiments, the DC control circuitry applies the same value of the DC voltage both to the first and the second pairs of trap electrodes. DC voltage difference between the pairs in the interior of the ion trap where ions are ejected is maintained close to 0.

In various embodiments of the third aspect, the RF control circuitry can be configured to generate the auxiliary RF voltage at a frequency that is an integer fraction of a frequency of the main RF voltage to auxiliary RF voltage having a frequency that is an integer fraction of a frequency of the main RF voltage. In particular embodiments, the RF control circuitry can be configured to eject ions with at a beta of about ⅔. In particular embodiments, the RF control circuitry can be configured to maintain the phase locking between the main RF voltage and the auxiliary RF voltage.

In various embodiments of the third aspect, the portion of the main RF voltage applied to the second pair of trap electrodes can be between about 2% and about 10% of the RF voltage difference between the first and second pairs of trap electrodes. In particular embodiments, the portion of the main RF voltage applied to the second pair of trap electrodes can be between about 3% and about 7% of the RF voltage difference between the first and second pairs of trap electrodes. In particular embodiments, the portion of the main RF voltage applied to the second pair of trap electrodes can be between about 4% and about 6% of the RF voltage difference between the first and second pairs of trap electrodes.

In various embodiments of the third aspect, the kinetic energy distribution factor can be between about 50 and about 100, such as between about 60 and about 95, even between about 70 and about 90.

DRAWINGS

For a more complete understanding of the principles disclosed herein, and the advantages thereof, reference is now made to the following descriptions taken in conjunction with the accompanying drawings, in which.

Figure 10:
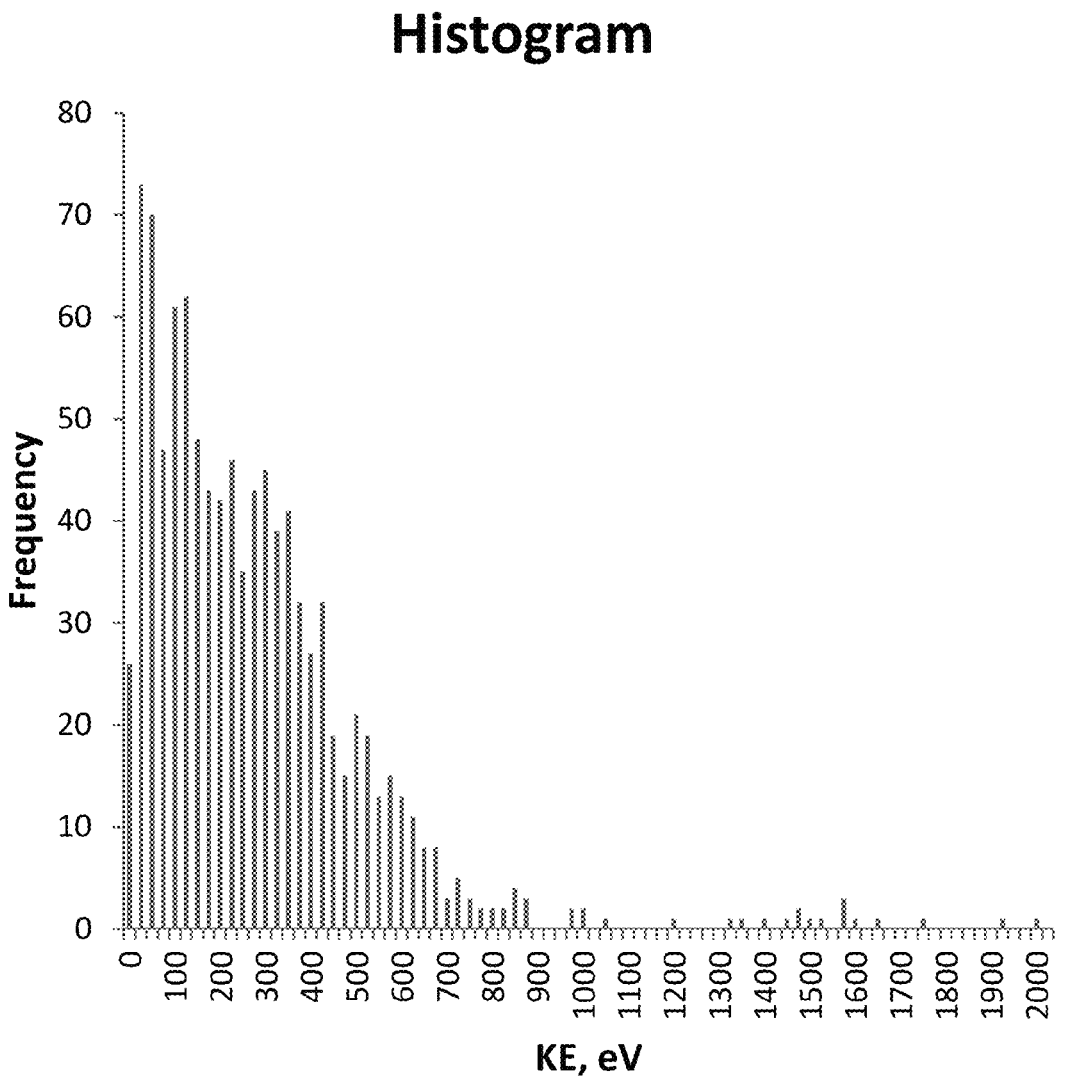
Figure 11:
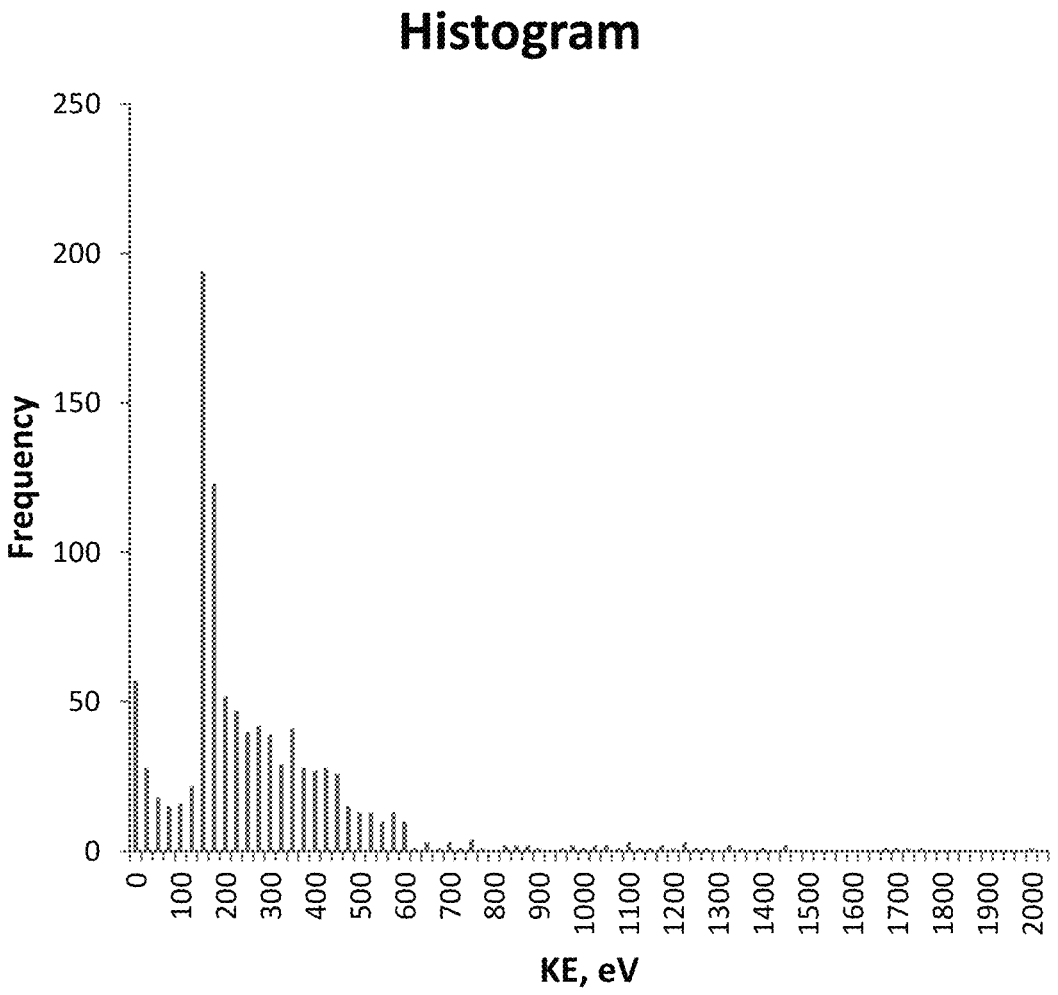

FIGS. 10 and 11 are histograms showing the kinetic energy distribution of ions ejected from a linear ion trap, in accordance with various embodiments It is to be understood that the figures are not necessarily drawn to scale, nor are the objects in the figures necessarily drawn to scale in relationship to one another. The figures are depictions that are intended to bring clarity and understanding to various embodiments of apparatuses, systems, and methods disclosed herein. Wherever possible, the same reference numbers will be used throughout the drawings to refer to the same or like parts. Moreover, it should be appreciated that the drawings are not intended to limit the scope of the present teachings in any way.

DESCRIPTION OF VARIOUS EMBODIMENTS

Embodiments of systems and methods for ion separation are described herein.

The section headings used herein are for organizational purposes only and are not to be construed as limiting the described subject matter in any way.

In this detailed description of the various embodiments, for purposes of explanation, numerous specific details are set forth to provide a thorough understanding of the embodiments disclosed. One skilled in the art will appreciate, however, that these various embodiments may be practiced with or without these specific details. In other instances, structures and devices are shown in block diagram form. Furthermore, one skilled in the art can readily appreciate that the specific sequences in which methods are presented and performed are illustrative and it is contemplated that the sequences can be varied and still remain within the spirit and scope of the various embodiments disclosed herein.

All literature and similar materials cited in this application, including but not limited to, patents, patent applications, articles, books, treatises, and internet web pages are expressly incorporated by reference in their entirety for any purpose. Unless described otherwise, all technical and scientific terms used herein have a meaning as is commonly understood by one of ordinary skill in the art to which the various embodiments described herein belongs.

It will be appreciated that there is an implied "about" prior to the temperatures, concentrations, times, pressures, flow rates, cross-sectional areas, etc. discussed in the present teachings, such that slight and insubstantial deviations are within the scope of the present teachings. In this application, the use of the singular includes the plural unless specifically stated otherwise. Also, the use of "comprise", "comprises", "comprising", "contain", "contains", "containing", "include", "includes", and "including" are not intended to be limiting. It is to be understood that both the foregoing general description and the following detailed description are exemplary and explanatory only and are not restrictive of the present teachings.

As used herein, "a" or "an" also may refer to "at least one" or "one or more." Also, the use of "or" is inclusive, such that the phrase "A or B" is true when "A" is true, "B" is true, or both "A" and "B" are true. Further, unless otherwise required by context, singular terms shall include pluralities and plural terms shall include the singular.

A "system" sets forth a set of components, real or abstract, comprising a whole where each component interacts with or is related to at least one other component within the whole.

Mass Spectrometry Platforms

Figure 1:
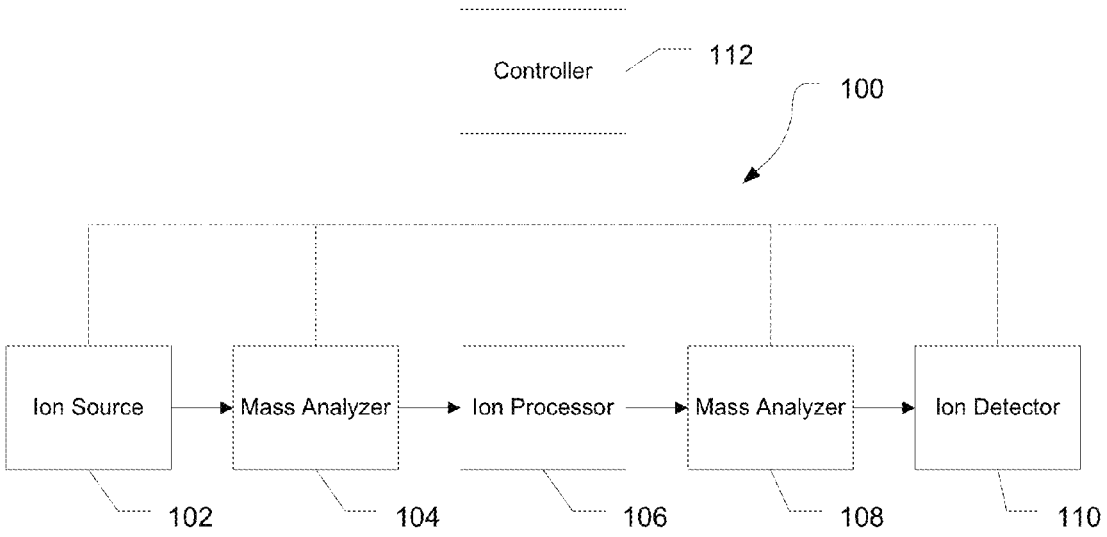
FIG. 1 is a block diagram of an exemplary mass spectrometry system, in accordance with various embodiments.

Various embodiments of mass spectrometry platform 100 can include components as displayed in the block diagram of FIG. 1. In various embodiments, elements of FIG. 1 can be incorporated into mass spectrometry platform 100. According to various embodiments, mass spectrometer 100 can include an ion source 102, a mass analyzer 104, an ion processor 106, a mass analyzer 108, an ion detector 110, and a controller 112.

In various embodiments, the ion source 102 generates a plurality of ions from a sample. The ion source can include, but is not limited to, a matrix assisted laser desorption/ionization (MALDI) source, electrospray ionization (ESI) source, atmospheric pressure chemical ionization (APCI) source, atmospheric pressure photoionization source (APPI), inductively coupled plasma (ICP) source, electron ionization source, chemical ionization source, photoionization source, glow discharge ionization source, thermospray ionization source, and the like.

In various embodiments, the mass analyzer 104 can separate ions based on a mass-to-charge ratio of the ions. For example, the mass analyzer 104 can include a quadrupole mass filter analyzer, a quadrupole ion trap analyzer, a time-of-flight (TOF) analyzer, an electrostatic trap mass analyzer (e.g., ORBITRAP mass analyzer), Fourier transform ion cyclotron resonance (FT-ICR) mass analyzer, and the like. In various embodiments, the mass analyzer 104 can also be configured to fragment the ions using collision induced dissociation (CID), electron transfer dissociation (ETD), negative electron transfer dissociation (nETD), proton transfer reaction (PTR), electron capture dissociation (ECD), photo induced dissociation (PID), surface induced dissociation (SID), and the like, and further separate the fragmented ions based on the mass-to-charge ratio.

In various embodiments, the ion processor 106 can trap ions, fragment ions and transport ions back to mass analyzer 108. Alternatively, ion processor 106 can transport ions back to mass analyzer 104 to analyzer the fragment ions or selected a subset of fragment ions for further fragmentation.

In various embodiments, the second mass analyzer 108 can analyze fragment ions produced in the ion processor 106, separate ions based on a mass-to-charge ratio of the ions. For example, the mass analyzer 108 can include a quadrupole mass filter analyzer, a quadrupole ion trap analyzer, a time-of-flight (TOF) analyzer, an electrostatic trap mass analyzer (e.g., ORBITRAP mass analyzer), Fourier transform ion cyclotron resonance (FT-ICR) mass analyzer, and the like.

In various embodiments, the ion detector 110 can detect ions. For example, the ion detector 110 can include an electron multiplier, a Faraday cup, and the like. Ions within or leaving the mass analyzer can be detected by the ion detector. In various embodiments, the ion detector can be quantitative, such that an accurate count of the ions can be determined.

In various embodiments, the system can include ion optics to guide and focus ions as they move from the ion source 102 to the mass analyzer 104. Additional ion optics may be utilized to guide or focus ions as they move from the mass analyzer 104 to the ion processor 106 to mass analyzer 108 (or back to mass analyzer 104) and further to ion detector 110. The ion optics can include ion lenses, ion guides, and the like.

In various embodiments, the controller 112 can communicate with the ion source 102, the mass analyzer 104, ion processor 106, the mass analyzer 108, and the ion detector 110. For example, the controller 112 can configure the ion source or enable/disable the ion source. Additionally, the controller 112 can configure the mass analyzer 104 to select a particular mass range to detect. Further, the controller 112 can configure the ion processor 106 for optimum collision energy and residence time in the ion processor 106. Further, the controller 112 can select mass resolution and a mass range of mass analyzer 108 to analyze fragment ions produced in the ion processor 106. Further, the controller 112 can adjust the sensitivity of the ion detector 110, such as by adjusting the gain. Additionally, the controller 112 can adjust the polarity of the ion detector 110 based on the polarity of the ions being detected. For example, the ion detector 110 can be configured to detect positive ions or be configured to detected negative ions.

Linear Ion Trap

Figure 2A:
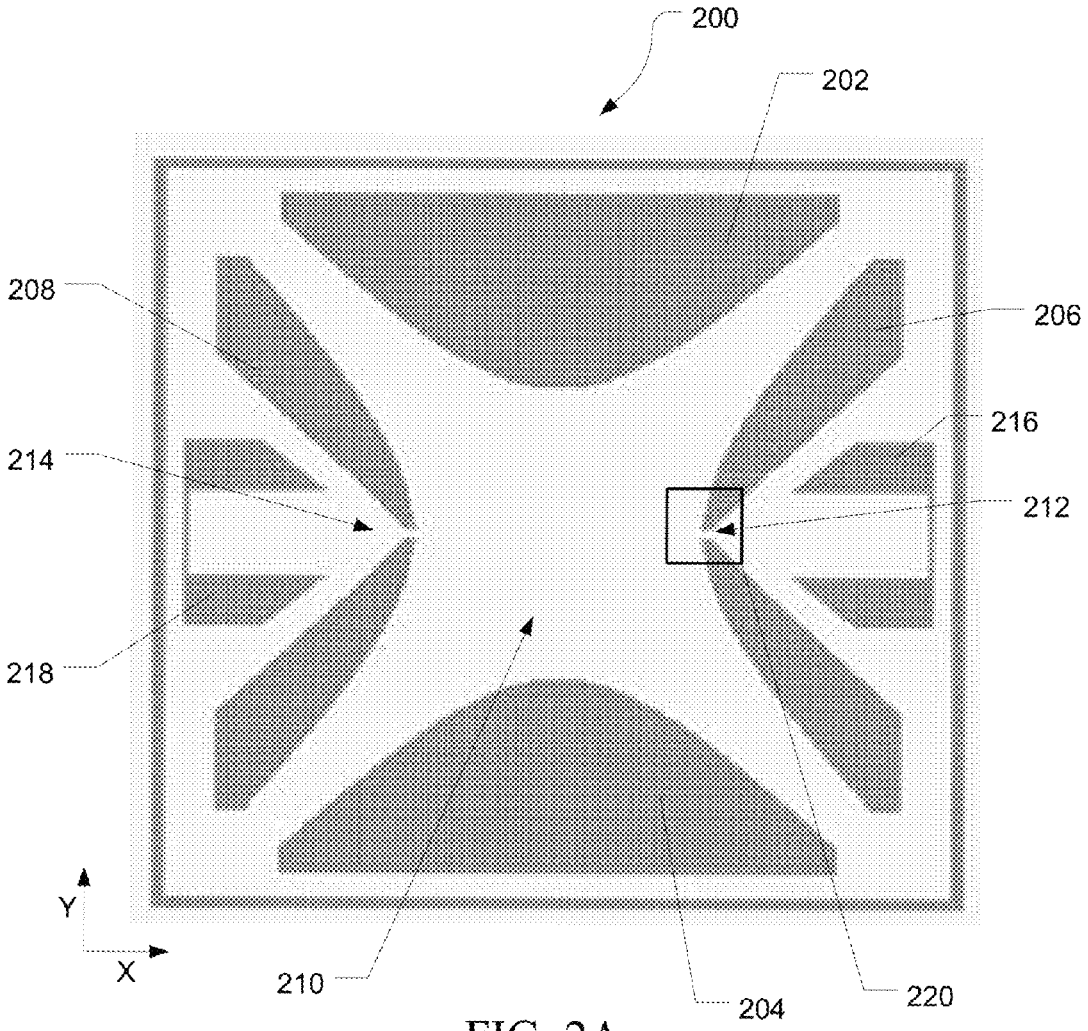
FIGS. 2A and 2B are diagrams illustrating a cross section of an linear ion trap, in accordance with various embodiments.

FIG. 2A shows a cross section of linear ion trap 200, in accordance with various embodiments. Linear ion trap 200 can include a first pair of trap electrodes or rods 202 and 204 and a second pair of trap electrodes of rods 206 and 208. The spacing of the trap electrodes 202, 204, 206, and 208 can define a trap interior 210 within which ions can be trapped by application of appropriate RF and DC voltages. In various embodiments, the trap electrodes 202, 204, 206, and 208 can have a hyperbolic or near hyperbolic surface facing the trap interior. When RF potentials are applied to the trap electrodes 202, 204, 206, and 208, the hyperbolic surface can produce a quadrupolar trapping field within the trap interior 210. In various embodiments, the linear ion trap has no stretch, with the radius of the ion trap being the same in both the X and the Y direction. In various embodiments, other surface shapes, such as rods having a circular or semi-circular cross section, may provide sufficient approximation of a hyperbolic trapping field within the trap interior.

In various embodiments, the trapping field for trapping ions within the trap interior 210 can be generated by applying a RF potential to trap electrodes 202 and 204 and applying a similar RF potential that is 180 degrees out of phase to trap electrodes 206 and 208. Applying similar but out of phase RF potentials to the two pairs of trap electrodes can be referred to as a balanced RF potential or balanced mode. The trapping of ions within the trap interior 210 can depend on the frequency profile of the RF potential as well as the amplitude.

Alternatively, the linear ion trap can be operated in an unbalanced mode, where the amplitude of the RF potential on trap electrodes 202 and 204 is different from the RF potential on the trap electrodes 206 and 208. For example, an RF potential can be applied to trap electrodes 202 and 204 with no out of phase RF potential applied to trap electrodes 206 and 208. However, the overall difference in amplitudes between the first pair of trap electrodes (202, 204) and the second pair of trap electrodes (206, 208) needs to be maintained, requiring the amplitude of the RF potential applied to the first pair (202, 204) to be two times the amplitude required in balanced mode.

Figure 2B:
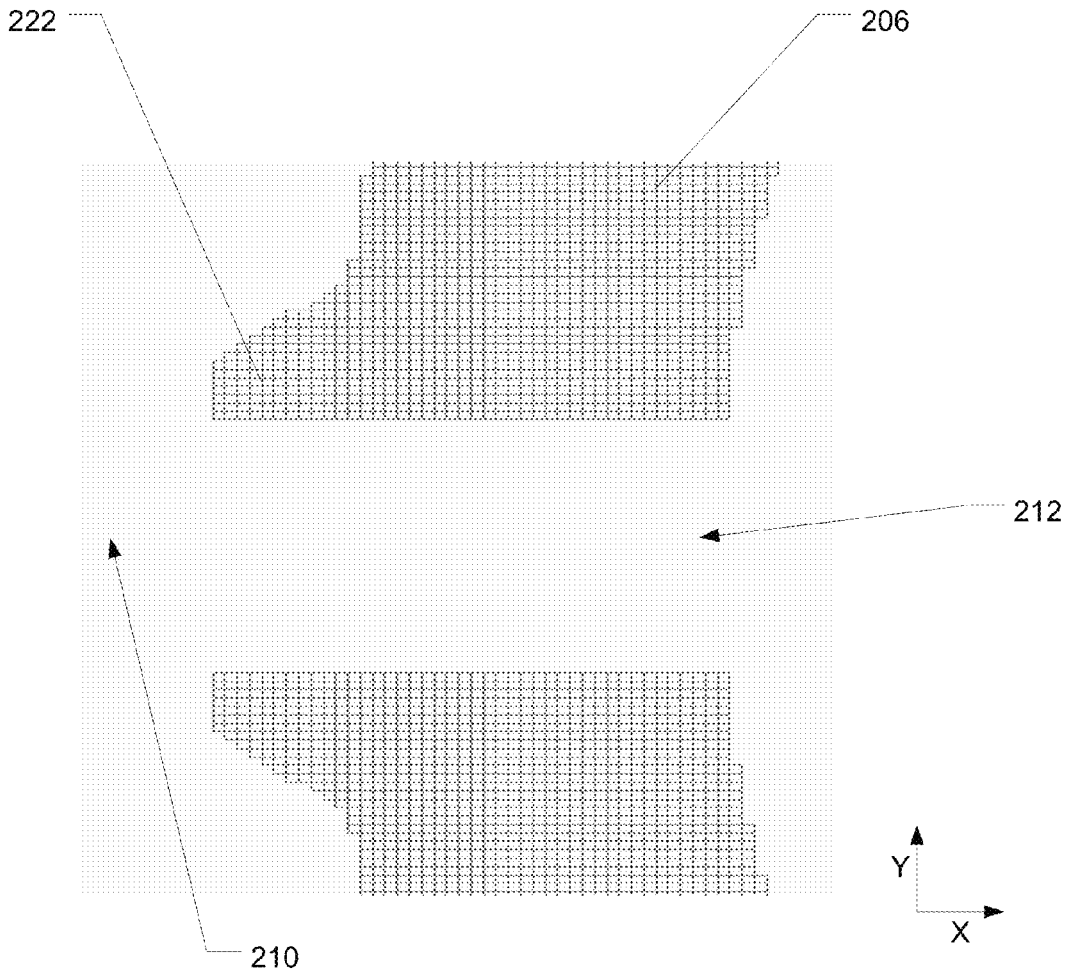

Trap electrodes 206 and 208 can include exit apertures 212 and 214 through which ions leave the linear ion trap during resonant ejection. Trap electrodes 206 and 208 can include a bulge 222 on the interior surface surrounding exit apertures 212 and 214, illustrated in FIG. 2B which shows an enlargement of area 220. Additionally, the linear ion trap 200 can include insert electrodes 216 and 218 positioned adjacent to the exit apertures 212 and 214.

During resonant ejections, ions can leave through both exit aperture 212 or 214 with a first portion of the ions exiting through 212 and a second portion of the ions exiting through 214. In various embodiments, ion optics can be positioned downstream of both trap exits and both portions of the ions can be utilized in downstream analysis. Generally, this can require duplication of some or all of the downstream ion optics and detector mechanisms. In other embodiments, duplication of the downstream ion optics can be impractical, and ions exiting only in one direction (such as through exit aperture 212) can be utilized. In such embodiments, trap electrode 208 may not include an exit aperture and insert electrode 218 may not be present.

In various embodiments, resonant ejection can be performed while the trap is in unbalanced mode, with a main RF potential applied primarily to the first pair of trap electrodes (202, 204) and an auxiliary RF potential applied to the second pair of trap electrodes (206, 208). The auxiliary RF potential can be used to excite the ions within the trap in order to eject them. When the auxiliary RF potential is at or near the resonant frequency of the ion within the trap, the motion of the ion can build until they move out of the exit aperture 212. Once outside of the trap, the ions can move through insert electrode 216 and into ion optics (not shown) to guide the ions to downstream devices for further analysis.

In various embodiments, a portion of the main RF potential can be applied to the second pair of trap electrodes (206, 208) and the main RF potential on the first pair of trap electrodes (202, 204) can be increased proportionally to maintain the voltage difference between the first and second pair of trap electrodes. Additionally, a DC voltage can be applied to the insert electrode 216, subjection ions within the space between the trap electrode 206 and insert electrode 216 to an accelerating field.

Due to differences in initial position and initial velocity of ions within the ion trap and random collisions ions experience before ejection within the interior of the linear ion trap, there can be a spread of kinetic energies of the ions as they pass through exit aperture 212. After passing the slot, ions enter the space between the exterior of RF rod electrode and insert electrode, where ions can be accelerated by voltage difference between the trap electrode 206 and insert electrode 216. Ions of the same mass-to-charge ratio having larger kinetic energy (fast ions) before ejection enter and leave the slot of the exit aperture 212 earlier than ions with less kinetic energy, the slow ions. Ions are ejected when RF is near its maximum absolute value (phase angle~270 degrees for positive ions). Fast ions enter the space between the trap electrode 220 and the insert electrode 216 when RF amplitude on the trap electrode is near its maximum absolute value. Slow ions see a lower absolute value of RF voltage when they enter the space. The effect of main RF voltage on the trap electrode 206 is deceleration of ions compared to the case when no main RF voltage is applied. A larger absolute value of RF voltage when fast ions enter the space after the slot results in larger deceleration of fast ions compared to slow ions. This is because the latter pass through the exit aperture 212 at a slightly later time when main RF voltage drops. As a result, the kinetic energy spread can be reduced.

In various embodiments, a DC bias voltage can be applied to the trap electrodes 202, 204, 206, and 208. Further, the DC bias voltage can be adjusted in a mass or m/z dependent manner. As the DC bias voltage would be the same on all four trap electrodes, ions within the trap will be unaffected by the DC bias voltage. However, as ions pass through the exit aperture 212, the DC bias voltage will contribute to the voltage difference between the trap electrode 206 and the insert electrode 216. By adjusting the DC bias voltage as ions of different masses are scanned out of the ion trap, the voltage difference can be optimized for each mass. Alternatively, the DC voltage on insert electrode 216 can be adjusted in a mass dependent manner. However, changing the DC voltage on insert electrode 216 can affect the tuning on ions optics downstream of the ion trap, and may be undesirable.

Figure 2C:
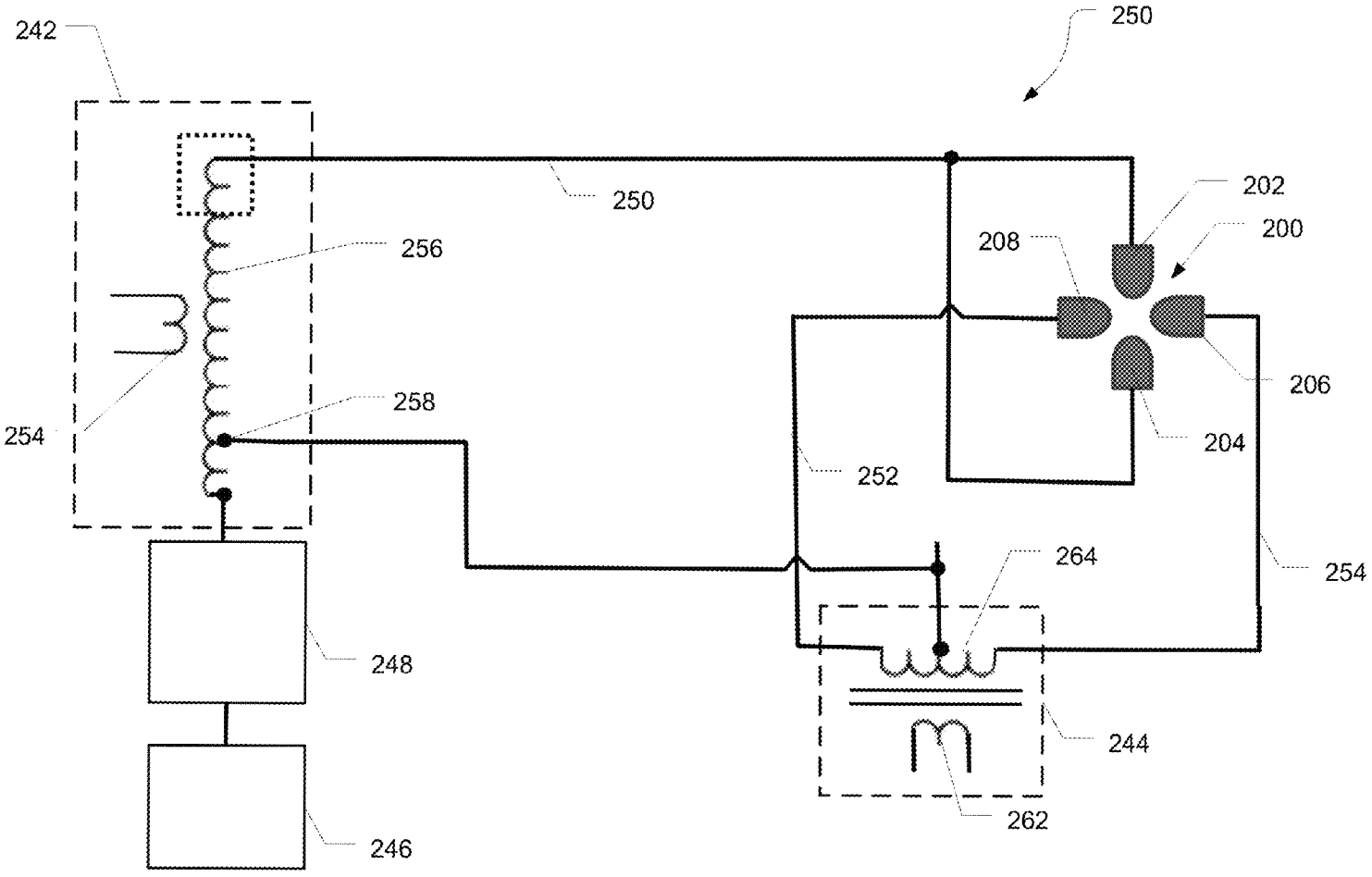
FIG. 2C is a diagram illustrating an exemplary RF supply circuitry for a linear ion trap, in accordance with various embodiments.

FIG. 2C illustrates an exemplary RF supply circuitry 250. Circuitry 250 can include a main RF transformer 242, an auxiliary transformer 244, a DC supply 246, and a low pass filter 248. The main RF transformer 242 can supply the main RF to trap electrodes 202 and 204 through electrical path 250, and the auxiliary transformer 244 can supply the auxiliary RF potential to trap electrodes 206 and 208 through electrical paths 252 and 254 respectively. DC supply 246 can provide a DC bias voltage to trap electrodes 202, 204, 206, and 208. Low pass filter 248 can filter high frequency electrical noise from the DC power supply that can affect the ions within the linear ion trap 200.

Main RF transformer 242 can include a primary winding 254 to supply a main RF waveform, and a secondary winding 256 to generate the required voltage for the main RF potential. A tap 258 positioned on the secondary winding after a small number of windings can draw the offset to be applied to the auxiliary RF potential. A similar number of additional windings at 260 can increase the main RF voltage by a compensating amount. Trap electrodes 202 and 204 can be fed from the same electrical path 250 such that main RF potential on trap electrodes 202 and 204 are in phase.

Auxiliary RF transforming 244 can include a primary winding 262 and a secondary winding 264. Primary winding 262 can supply an auxiliary RF waveform and the secondary winding can be configured to provide the required voltage for the auxiliary RF potential. Tap 258 can supply a portion of the main RF potential, and a DC bias voltage to the secondary winding. Electrical path 252 can supply the RF offset, the DC bias voltage, and the auxiliary RF potential to trap electrode 208, and electrical path 254 can supply the RF offset, the DC bias voltage, and the auxiliary RF potential to trap electrode 206. As electrical path 252 and 254 are on opposite sides of the transformer, the auxiliary RF potential provided to trap electrode 208 is 180 degree out of phase with the auxiliary RF potential provided to trap electrode 206.

In various embodiments, trap 200 can have a Kinetic Energy Distribution Factor of greater than 50, even greater than 70. Kinetic Energy Distribution Factor can be determined by measuring the percentage of 1000 m/z ions ejected from the trap within a 25 eV window when the trap is operated in an unbalanced mode, at beta=⅔ with phase locking. The Kinetic Energy Distribution Factor can be improved by applying an RF offset to the trap electrodes and a DC voltage to the insert electrodes. In various embodiments, trap 200 can have a Kinetic Energy Distribution Factor between about 50 and about 100, such as between about 60 and about 95, even between about 70 and about 90.

Figure 3:
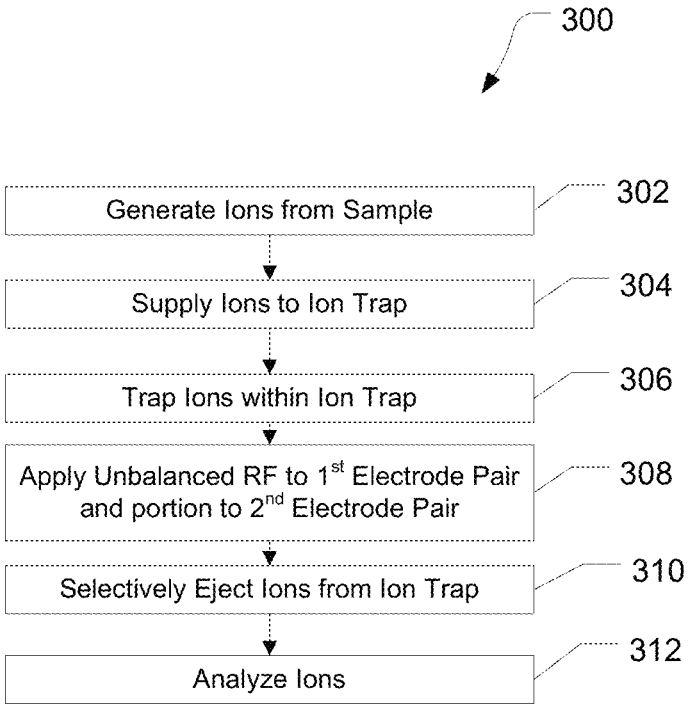
FIG. 3 is a flow diagram illustrating an exemplary method of analyzing ions, in accordance with various embodiments.

FIG. 3 illustrates an exemplary method 300 of analyzing ions using a linear ion trap that ejects ions with a reduced kinetic energy spread. At 302, ions can be produced from a sample. For example, an ion source can generate ions from a gaseous sample or a liquid sample. At 304, the ions can be supplied to a linear ion trap. In various embodiments, the ions can be accelerated, decelerated, focused, guided, and separated from neutral gas molecules by ion optics configured to move the ions from the ion source to the linear ion trap. In further embodiments, additional ion processing steps, such as fragmentation cells, ion mobility separators, and the like, may be positioned between the ion source and the linear ion trap.

At 306, the ions entering the linear ion trap can be trapped within a trapping field in the ion trap. The trapping field can be generated by a main RF potential that is applied to one or more rod pairs of the linear ion trap. In various embodiments, the trapping field can be selective, trapping ions within one or more narrow ranges of mass-to-charge ratios (m/z). In other embodiments, the trapping field can be more generally, trapping ions within a broad range of m/z, effectively having a high mass and low mass cutoff that are substantially different.

At 308, an unbalanced RF can be applied to the linear ion trap. This main RF can be predominately applied to a $1^{st}$ electrode pair (such as electrodes 202,204 of FIG. 2). Additionally, a small portion of this main RF can also be applied to the $2^{nd}$ electrode pair (such as electrodes 206,208 of FIG. 2), and the RF applied to the 1st electrode pair can be increased by the same amount. In various embodiments, the portion of the main RF applied to the second electrode pair can be between about 2% and about 10% of the main RF voltage, such as between about 3% and about 7%, even between about 4% and about 6%. Proportionally increasing the RF on the first electrode pair by the same amount can maintain the voltage difference between the first and second electrode pairs to maintain the field strength within the linear ion trap.

At 310, ions can be selectively ejection from the ion trap, such as through resonant ejection. In various embodiments, an auxiliary RF field can be applied to the second electrode pair. In various embodiments, the auxiliary RF voltage can have a frequency that is an integer fraction of the main RF voltage. In particular embodiments, the integer fraction can be about ⅓ (beta=⅔) or about ⅖ (beta=⅘). In various embodiments, the resonance ejection phase angle between the main RF and the auxiliary RF can be between about 2 degrees and about 12 degrees, such as between about 3 degrees and about 10 degrees, even about 4 degrees and about 7 degrees. In various embodiments, the main RF voltage and the auxiliary RF voltage can be phase locked such as with an angle between about 0 degrees and about 120 degrees for beta=⅔ or between 0 and 72 deg for beta=0.8.

The auxiliary dipolar RF field can excite ions to motion in the X direction (oscillating between the second pair of electrodes). For ions with a resonant frequency in the linear ion trap that is at or near the frequency of the auxiliary RF field, the motion can increase until the ions exit the linear ion trap. For other ions, the auxiliary RF field may not amplify the motion in the X direction and the ions can remain trapped within the main RF field never building enough velocity in the X direction to reach the exit.

In various embodiments, the auxiliary RF field and the main RF field can be varied in such a way as to scan through a m/z range sequentially ejecting ions at increasing (or decreasing) m/z. In other embodiments, ions at a specific m/z can be ejected from the ion trap without scanning.

While the ions are being ejected from the ion trap, a DC voltage can be applied to an insert electrode positioned close to the exit aperture. In various embodiments, the DC voltage can be between about −1000V and about −5000V for positively charged ions, even between about −1500V and about −3500V. In other embodiments, the DC voltage can be reversed for negatively charged ions, such that the DC voltage is between about 1000V and 5000V, even between about 1500V and 3500V.

In various embodiments, ions exiting from the linear ion trap can be accelerated while in between the exit aperture and the insert electrode. Faster moving ions can enter the slot earlier than the slower moving ions and for most of them RF phase angle can lies be between 180-270 deg. For phase locked conditions this range can be significantly compressed compared to non-phase-locked conditions. After passing the slot, ions enter the space between the exterior of RF rod electrode and insert electrode, where ions can be accelerated by voltage difference between the rod electrode and insert electrode. The voltage can be dynamic because of a RF applied to the rod electrode. If positive ions leave the ion trap after the main RF voltage has passed the maximum, is still negative, and is falling (in the absolute value), then initially fast moving ions can see a larger negative voltage on RF rod compared to the initially slow moving ions which exit later. Thus, the initially fast moving ions can experience a larger decelerating voltage difference between the RF rod and the insert electrode and initially slow moving ions can experience a lower deceleration voltage difference between the RF rod and the insert electrode. Thus, initially fast moving ions experience more deceleration than the initially slow moving ions. Voltage on insert electrode can be large such that ions stay in the space between RF rod and the insert electrode only long enough that the aforementioned effect of RF phase will provide more deceleration for fast ions vs. slow ions and the kinetic energy spread of the ions being ejected from the linear ion trap can be compressed. In various embodiments, the ejected ions can have a kinetic energy distribution factor (a percentage of ejected ions of similar m/z within a 25 eV kinetic energy window) of between about 60 and about 100, such as between about 70 and about 90.

At 312, the ions can be analyzed, such as to determine an m/z. In various embodiments, the ions can be scanned out of the trap and sent to a detector. Correlating the ions detected by the detector with the RF properties can provide an indication of m/z of the ion. Alternatively, the ions can be ejected from the ion trap and subjected to further analysis, such as fragmentation, mass determination using a separate mass analyzer, and the like.

Results

Figure 4:
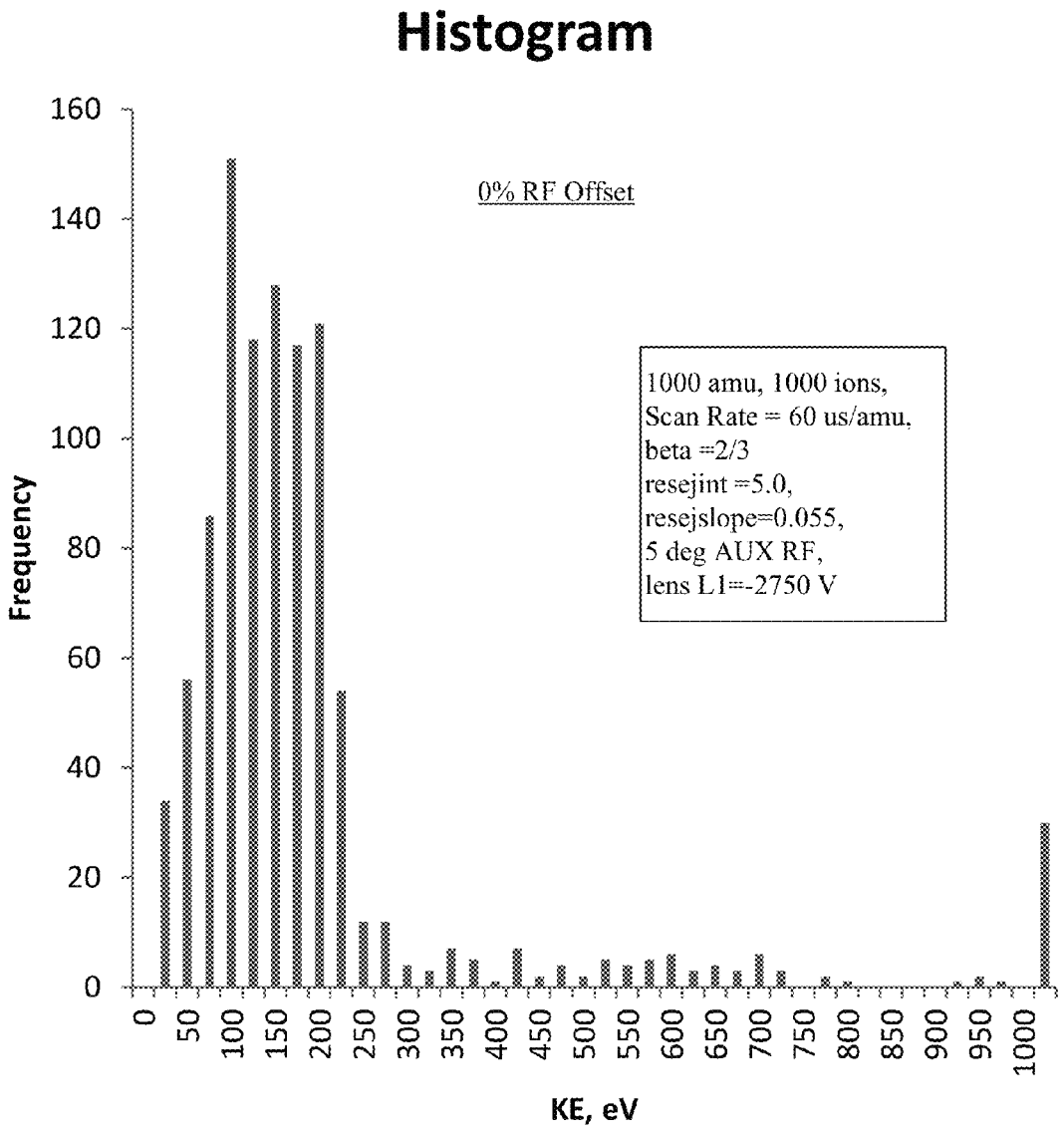
FIGS. 4 and 5 are histograms for 1000 ions showing the kinetic energy distribution of ions ejected from a linear ion trap, in accordance with various embodiments.
Figure 5:
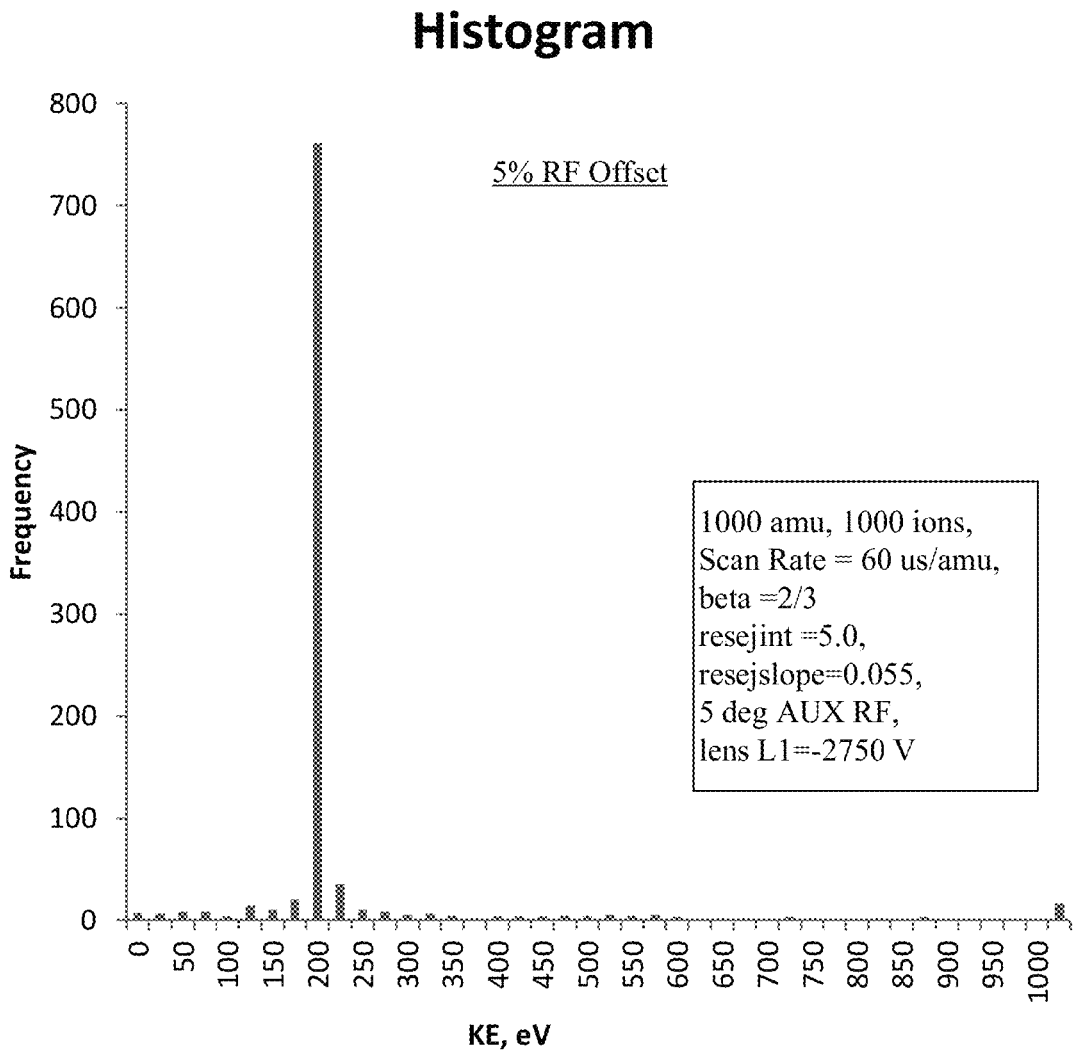

FIGS. 4 and 5 are histograms illustrating the kinetic energy distribution under various conditions. These data are for 1000 amu ions, with data collected for 1000 ions at a scan rate of 60 us/amu, and beta=⅔. Additionally, there is a 5 degree phase angle between the auxiliary and main RF voltages, and the insert lens is at −2750 V. In FIG. 4, the main RF voltage is only applied to the Y electrodes, resulting in a large kinetic energy spread with only about 15% of the ions occupying a 25 eV wide kinetic energy window. As can be seen, the kinetic energy of the bulk of the ions is spread over almost 250 eV. In contrast, FIG. 5 shows the results with a 5% RF offset (5% of the main RF voltage applied to the X electrodes and 105% of the main RF voltage applied to the Y electrodes). The result shows about 75% of the ions are within a 25 eV wide kinetic energy window. A Kinetic Energy Distribution Factor of greater than 70 is demonstrated. Kinetic Energy Distribution Factor is be determined by measuring the percentage of 1000 m/z ions ejected from the trap within a 25 eV window when the trap is operated in an unbalanced mode, at beta=⅔ with phase locking.

Figure 6:
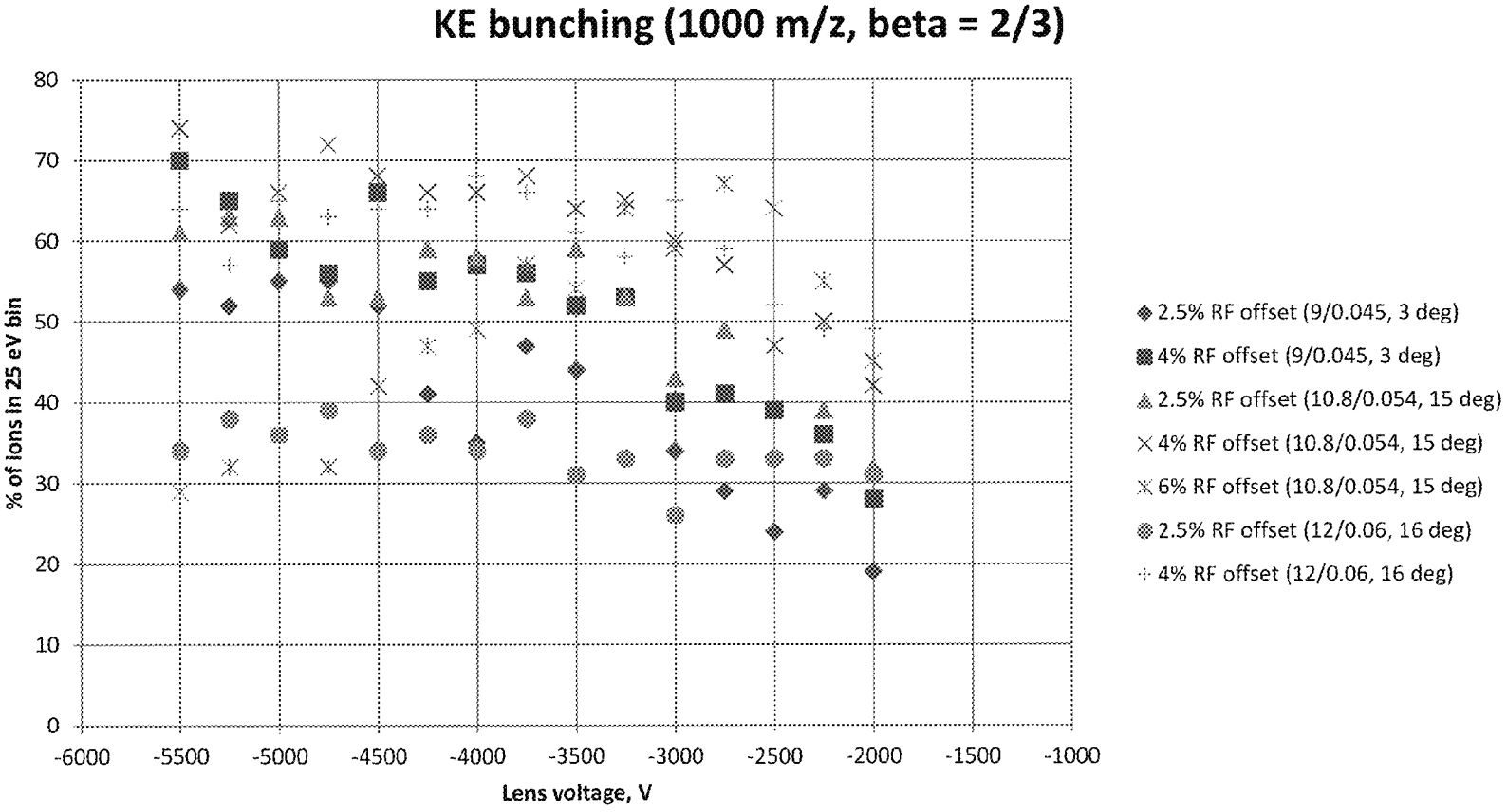
FIG. 6 is a graph showing the percentage of ions ejected with kinetic energies within a 25 eV window as a function of phase angle for various resonant ejection conditions, in accordance with various embodiments.

FIG. 6 is a graph showing the percentage of ions within a 25 eV kinetic energy spread under various resonant ejection conditions. By adjusting the phase angle between the auxiliary and main RF, greater than 60% of the ions can be concentrated within a 25 eV kinetic energy window at various scan rates.

Figure 7:
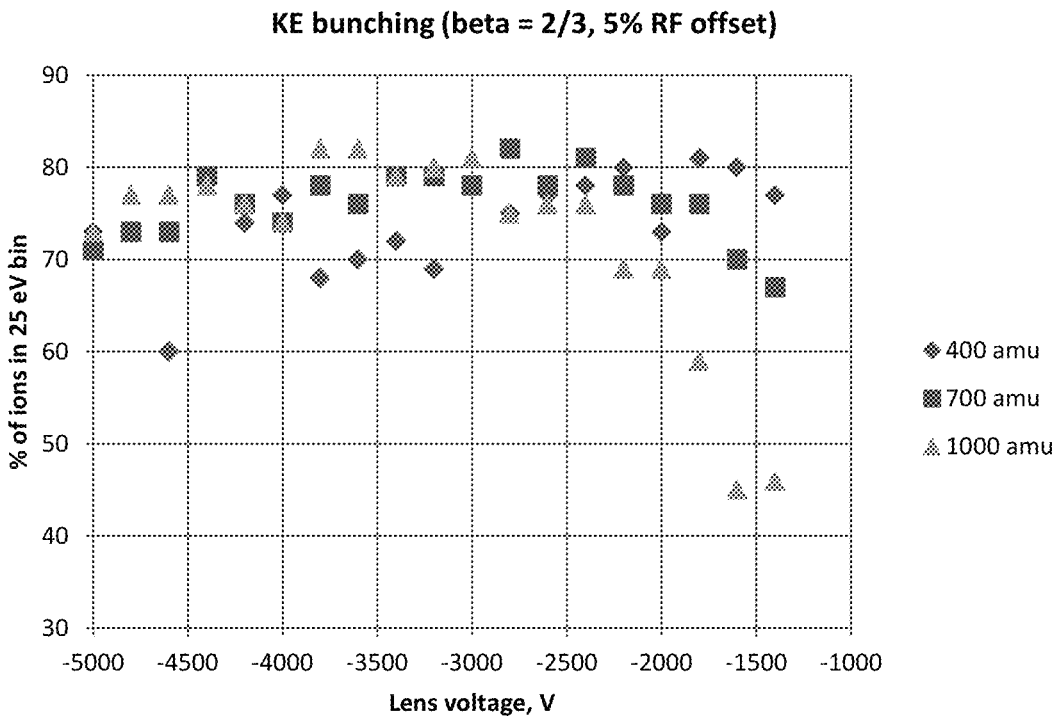
FIG. 7 is a graph showing the percentage of ions ejected with kinetic energies within a 25 eV window as a function of voltage on an exit lens for various mass-to-charge ratios, in accordance with various embodiments.
Figure 8:
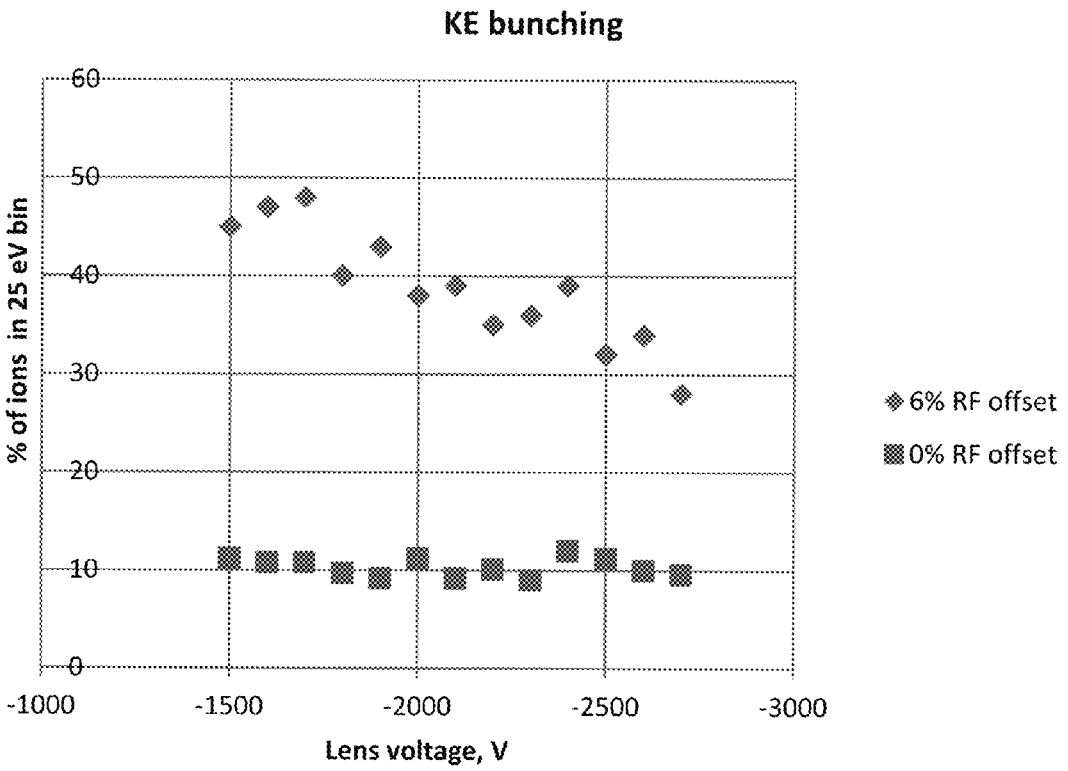
FIG. 8 is a graph comparing the percentage of ions ejected with kinetic energies within a 25 eV window as a function of lens voltage for beta=0.8, in accordance with various embodiments.

FIG. 7 shows the percentage of ions ejected with kinetic energies within a 25 eV window as a function of insert lens voltage, for ions of various sizes with an RF offset of 5% (5% of the main RF voltage applied to the X electrodes and 105% of the main RF voltage applied to the Y electrodes). Percentage of ions ejected with a kinetic energy within a 25 eV window is shown for ions of 400 m/z, 700 m/z, and 1000 m/z. Ions with a large m/z tend to have decreased percentage within the 25 eV kinetic energy window at lower absolute value voltage at the insert electrode 206, below 3000 V (absolute value). For ions of 400 m/z and 700 m/z, kinetic energy distribution factors of greater than 60% are demonstrated. Voltage range near −4000 V on the insert electrode is a compromising value where the kinetic energy distribution factors for ions of different sizes are near maximum. A Kinetic Energy Distribution Factor of greater than 50 is demonstrated. FIG. 8 shows the percentage of ions ejected with kinetic energies within a 25 eV window as a function of voltage on an exit lens with a beta of 0.8 with phase locking. The data show a significant increase in the percentage of ions ejected in a 25 eV bin (from about 10% to around 30-50% depending on the lens voltage) with an RF offset of 6% (6% of the main RF voltage applied to the X electrodes and 106% of the main RF voltage applied to the Y electrodes) compared to no main RF voltage applied to X rods.

Figure 9:
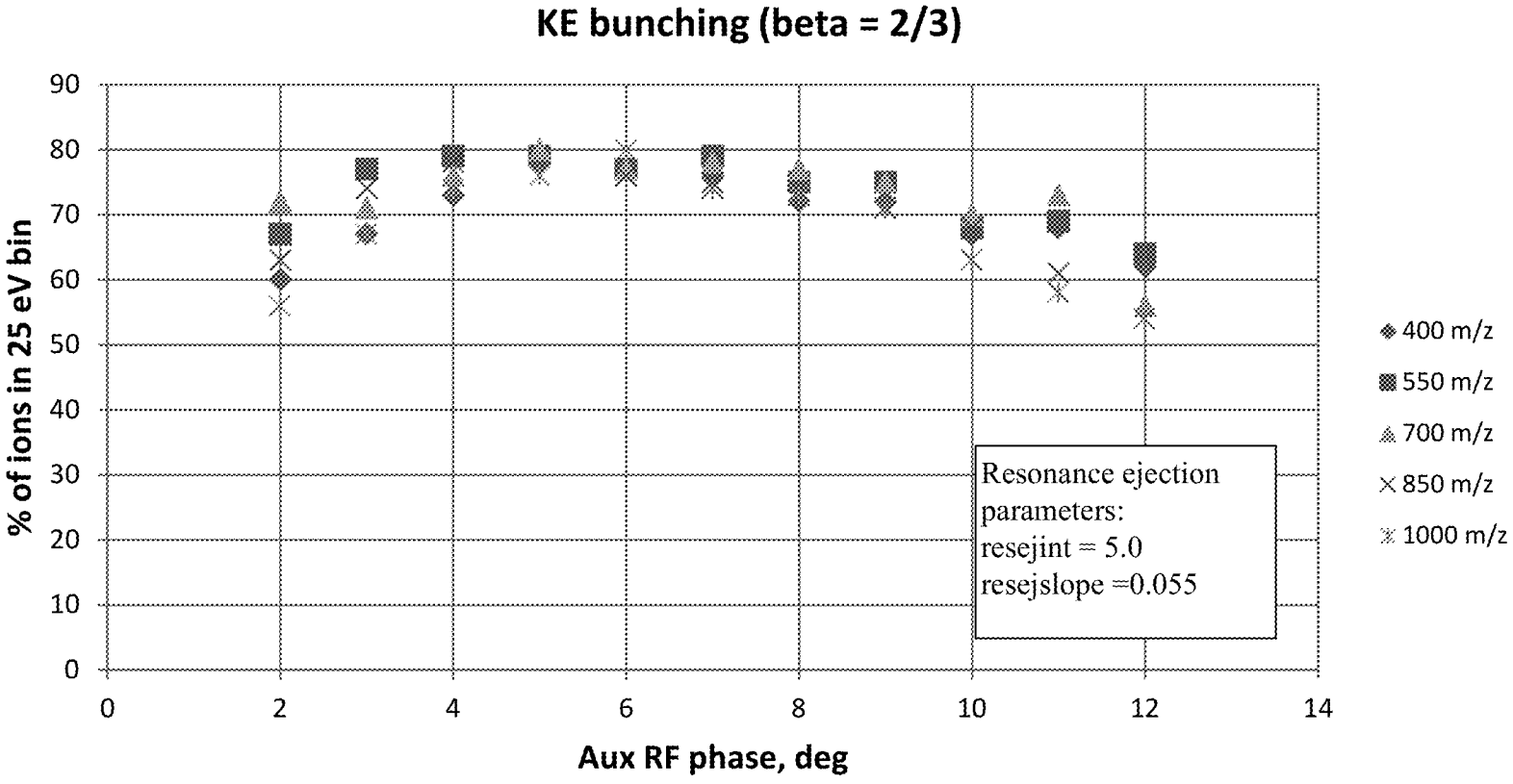
FIG. 9 is a graph showing the percentage of ions ejected with kinetic energies within a 25 eV window as a function of phase angle between the auxiliary and main RF voltages for various mass-to-charge ratios, in accordance with various embodiments.

FIG. 9 is a graph showing the percentage of ions ejected with kinetic energies within a 25 eV window as a function of phase angle between the auxiliary and main RF voltages (beta=⅔, phase locking) for ions of different sizes, 400 m/z, 550 m/z, 700 m/z, 850 m/z and 1000 m/z with an RF offset of 6% (6% of the main RF voltage applied to the X electrodes and 106% of the main RF voltage applied to the Y electrodes). Between about 4 degrees and about 7 degrees, greater than 70% of ions ejected fall within a 25 eV kinetic energy window for ions ranging from 400 m/z to 1000 m/z. A Kinetic Energy Distribution Factor of greater than 70 is demonstrated.

FIGS. 10 and 11 are histograms illustrating the kinetic energy distribution of 1000 ions without phase locking (q=0.88). In FIG. 10, the main RF voltage is only applied to the Y electrodes, resulting in a large kinetic energy spread (about 800 eV) with a max of about 7% of the ions (1000 total ions) within the most populated 25 eV wide kinetic energy window. In contrast, FIG. 11 shows the results with a 6% RF offset (6% of the main RF voltage applied to the X electrodes and 106% of the main RF voltage applied to the Y electrodes). The result show a significant increase in the percentage of ions ejected within the two 25 eV wide kinetic energy window between 150 and 200 eV, with almost 20% of the ions within one 25 eV window. Additionally, the overall spread is substantially reduced with almost all of the ions ejected with kinetic energies between 0 and 600 eV.

While the present teachings are described in conjunction with various embodiments, it is not intended that the present teachings be limited to such embodiments. On the contrary, the present teachings encompass various alternatives, modifications, and equivalents, as will be appreciated by those of skill in the art.

Further, in describing various embodiments, the specification may have presented a method and/or process as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process should not be limited to the performance of their steps in the order written, and one skilled in the art can readily appreciate that the sequences may be varied and still remain within the spirit and scope of the various embodiments.

What is claimed is:

1. A system for analyzing a sample comprising:

an ion source;

an ion detector;

a linear ion trap including:

a plurality of trap electrodes spaced apart from each other and surrounding a trap interior, the plurality of trap electrodes including a first pair of trap electrodes and a second pair of trap electrodes; and an insert DC electrode;

at least a first trap electrode of the second pair of trap electrodes including a trap exit comprising an aperture;

the insert DC electrode positioned adjacent to the trap exit;

the trap electrodes configured for generating a RF trapping field in the trap interior and for mass selective ejection of ions from the trap interior;

a voltage controller configured to apply a DC voltage to the insert DC electrode;

an RF control circuitry configured to:

apply a main RF voltage provided by a main RF transformer to the first pair of trap electrodes, the main RF transformer including a first number of windings needed to provide the main RF voltage, a tap after a subset of the windings, and additional windings, the number of additional windings being equal to or plus or minus one integer to the number of windings in the subset of the windings;

apply a portion of the main RF voltage to the second pair of trap electrodes using the tap of the main RF transformer and proportionally increase the main RF voltage applied to the first pair of trap electrodes using the additional windings of the main RF transformer to maintain a main RF voltage difference between the first and second pairs of trap electrodes; and apply an auxiliary RF voltage provided by an auxiliary RF transformer to the second pair of trap electrodes in a dipolar fashion.

2. The system of claim 1 wherein the absolute value of the DC voltage is between about 1000V and about 5000 V.

3. The system of claim 1 wherein the absolute value of the DC voltage is between about 1500V and about 3500 V.

4. The system of claim 1 wherein the RF control circuitry is configured to generate the auxiliary RF voltage at a frequency that is an integer fraction of a frequency of the main RF voltage.

5. The system of claim 4 wherein the RF control circuitry is configured to eject ions with at a beta of about ⅔.

6. The system of claim 4 wherein the RF control circuitry is configured to maintain the phase locking between the main RF voltage and the auxiliary RF voltage.

7. The system of claim 1 wherein the portion of the main RF voltage applied to the second pair of trap electrodes is between about 2% and about 10% of the RF voltage difference between the first and second pairs of trap electrodes.

8. The system of claim 7 wherein the portion of the main RF voltage applied to the second pair of trap electrodes is between about 3% and about 7% of the RF voltage difference between the first and second pairs of trap electrodes.

9. The system of claim 7 wherein the portion of the main RF voltage applied to the second pair of trap electrodes is between about 4% and about 6% of the RF voltage difference between the first and second pairs of trap electrodes.

10. The system of claim 1 wherein the kinetic energy distribution factor is between about 50 and about 100.

11. The system of claim 10 wherein the kinetic energy distribution factor is between about 70 and about 90.

12. The system of claim 1 wherein the RF circuitry is further configured to apply a DC bias voltage to the plurality of trap electrodes.

13. The system of claim 12 wherein the DC bias voltage is varied as a function of the mass of the ions exiting the ion trap.

14. A method for identifying components of a sample comprising:

supplying ions to a mass selective linear ion trap, the ion trap including a plurality of trap electrodes spaced apart from each other and surrounding a trap interior and a DC insert electrode positioned adjacent to a trap exit aperture formed in at least one of the trap electrodes, the trap electrodes configured for generating a RF trapping field in the trap interior;

trapping the ions within the RF trapping field;

applying a DC voltage to the insert DC electrode;

applying a main RF voltage to the first pair of trap electrodes;

tapping a main RF transformer after a number of windings to apply a portion of the main RF to the second pair of trap electrodes and proportionally increasing the main RF applied to the first pair of trap electrodes using a number of additional windings to maintain a main RF voltage difference between the first and second pairs of trap electrodes; and selectively ejecting ions from the trap interior based on their mass by applying an auxiliary RF voltage to the second pair of trap electrodes, the auxiliary RF voltage applied 180° out of phase between the first and a second trap electrode of the second pair of trap electrodes.

15. The method of claim 14 wherein the RF control circuitry is configured to generate the auxiliary RF voltage at a frequency that is an integer fraction of a frequency of the main RF voltage.

16. The method of claim 14 wherein the portion of the main RF voltage applied to the second pair of trap electrodes is between about 2% and about 10% of the RF voltage difference between the first and second pairs of trap electrodes.

17. The method of claim 14 wherein the kinetic energy distribution factor is between about 50 and about 100.

18. The method of claim 14 further comprising applying a DC bias voltage to the plurality of trap electrodes.

19. A mass selective ion trapping device comprising:

a plurality of trap electrodes spaced apart from each other and surrounding a trap interior, the plurality of trap electrodes including a first pair of trap electrodes and a second pair of trap electrodes, at least one of the trap electrodes of the second pair of trap electrodes including a trap exit comprising an aperture, the trap electrodes configured for generating a RF trapping field in the trap interior and for mass selective ejection of ions from the trap interior;

an insert DC electrode positioned adjacent to the trap exit;

a voltage controlled configured to apply a DC voltage to the insert DC electrode;

an RF circuitry configured to:

apply a main RF voltage to the first pair of trap electrodes;

tapping a main RF transformer after a number of windings to apply a portion of the main RF to the second pair of trap electrodes and proportionally increasing the main RF applied to the first pair of trap electrodes using a number of additional windings to maintain a main RF voltage difference between the first and second pairs of trap electrodes; and apply an auxiliary RF voltage to the second pair of trap electrodes, the auxiliary RF voltage applied 180° out of phase between the first and a second trap electrode of the second pair of trap electrodes.

20. The mass selective ion trapping device of claim 19 wherein the RF control circuitry is configured to generate the auxiliary RF voltage at a frequency that is an integer fraction of a frequency of the main RF voltage.

21. The mass selective ion trapping device of claim 19 wherein the portion of the main RF voltage applied to the second pair of trap electrodes is between about 2% and about 10% of the RF voltage difference between the first and second pairs of trap electrodes.

22. The mass selective ion trapping device of claim 19 wherein the kinetic energy distribution factor is between about 50 and about 100.

23. The mass selective ion trapping device of claim 19 wherein the RF circuitry is further configured to apply a DC bias voltage to the plurality of trap electrodes.

* * * * *